US009111549B2

(12) United States Patent
Cederberg et al.

(10) Patent No.: US 9,111,549 B2
(45) Date of Patent: Aug. 18, 2015

(54) HEARING AID AND A METHOD OF IMPROVED AUDIO REPRODUCTION

(71) Applicant: Widex A/S, Lynge (DK)

(72) Inventors: Jorge Cederberg, Farum (DK); Henning Haugaard Andersen, Birkerod (DK); Mette Dahl Meincke, Varlose (DK); Andreas Brinch Nielsen, Copenhagen (DK)

(73) Assignee: Widex A/S, Lynge (DK)

( * ) Notice: Subject to any disclaimer, the term of this patent is extended or adjusted under 35 U.S.C. 154(b) by 356 days.

(21) Appl. No.: 13/834,071

(22) Filed: Mar. 15, 2013

(65) Prior Publication Data

US 2013/0182875 A1 Jul. 18, 2013

Related U.S. Application Data

(63) Continuation-in-part of application No. PCT/EP2010/069145, filed on Dec. 8, 2010.

(51) Int. Cl.
*H04R 25/00* (2006.01)
*G10L 25/93* (2013.01)

(52) U.S. Cl.
CPC ..... *G10L 25/93* (2013.01); *H04R 25/353* (2013.01)

(58) Field of Classification Search
CPC ..... G01L 25/93; H04R 25/353
USPC ..... 381/316, 312, 320, 60
See application file for complete search history.

(56) References Cited

U.S. PATENT DOCUMENTS 3,385,937 A * 5/1968 Lafon ..... 381/316
4,220,160 A * 9/1980 Kimball et al. ..... 600/528

(Continued)

FOREIGN PATENT DOCUMENTS

CN 101682825 A 3/2010
WO 2007/000161 A1 1/2007

OTHER PUBLICATIONS

International Search Report with Written Opinion of the International Searching Authority for PCT/EP2010/069145 dated Aug. 2, 2011.

(Continued)

*Primary Examiner* — Davetta W Goins
*Assistant Examiner* — Phylesha Dabney
(74) *Attorney, Agent, or Firm* — Sughrue Mion, PLLC

(57) ABSTRACT

A hearing aid comprising a frequency shifter (20) has means (22) for detecting a first frequency and a second frequency in an input signal. The frequency shifter (20) transposes a first frequency range of the input signal to a second frequency range of the input signal based on the presence of a fixed relationship between the first and the second detected frequency. The means (34, 35, 36) for detecting the fixed relationship between the first and the second frequency is used for controlling the frequency transposer (20). A speech detector (26) configured for detecting the presence of voiced and unvoiced speech is provided for suppressing the transposition of voiced-speech signals in order to preserve the speech formants. The purpose of transposing frequency bands in this way in a hearing aid is to render inaudible frequencies audible to a user of the hearing aid while maintaining the original envelope, harmonic coherence and speech intelligibility of the signal. The invention further provides a method for shifting a frequency range of an input signal in a hearing aid.

14 Claims, 8 Drawing Sheets

(56) References Cited

U.S. PATENT DOCUMENTS

| | | | | |
|---|---|---|---|---|
| 4,843,623 | A * | 6/1989 | Lafon et al. | 381/316 |
| 5,014,319 | A * | 5/1991 | Leibman | 381/316 |
| 6,285,979 | B1 | 9/2001 | Ginzburg et al. | |
| 6,408,273 | B1 * | 6/2002 | Quagliaro et al. | 704/271 |
| 8,588,445 | B2 | 11/2013 | Ito et al. | |
| 2004/0175010 | A1 | 9/2004 | Allegro et al. | |
| 2013/0182875 | A1 * | 7/2013 | Cederberg et al. | 381/317 |

OTHER PUBLICATIONS

Office Action for corresponding Chinese Application No. 201080070566.1 dated May 6, 2014 with English translation.

* cited by examiner

22

HEARING AID AND A METHOD OF IMPROVED AUDIO REPRODUCTION

RELATED APPLICATIONS

The present application is a continuation-in-part of application PCT/EP2010/069145, filed on 8 Dec. 2010, in Europe, and published as WO2012076044 A1.

BACKGROUND OF THE INVENTION

1. Field of the Invention

This application relates to hearing aids. The invention, more specifically, relates to hearing aids having means for reproducing sounds at frequencies otherwise beyond the perceptive limits of a hearing-impaired user. The invention further relates to a method of processing signals in a hearing aid.

Individuals with a degraded auditory perception are in many ways inconvenienced or disadvantaged in life. Provided a residue of perception exists they may, however, benefit from using a hearing aid, i.e. an electronic device adapted for amplifying the ambient sound suitably to offset the hearing deficiency. Usually, the hearing deficiency will be established at various frequencies and the hearing aid will be tailored to provide selective amplification as a function of frequency in order to compensate the hearing loss according to those frequencies.

A hearing aid is defined as a small, battery-powered device, comprising a microphone, an audio processor and an acoustic output transducer, configured to be worn in or behind the ear by a hearing-impaired person. By fitting the hearing aid according to a prescription calculated from a measurement of a hearing loss of the user, the hearing aid may amplify certain frequency bands in order to compensate the hearing loss in those frequency bands. In order to provide an accurate and flexible amplification, most modern hearing aids are of the digital variety. Digital hearing aids incorporate a digital signal processor for processing audio signals from the microphone into electrical signals suitable for driving the acoustic output transducer according to the prescription.

However, there are individuals with a very profound hearing loss at high frequencies who do not gain any improvement in speech perception by amplification of those frequencies. Hearing ability could be close to normal at low frequencies while decreasing dramatically at high frequencies. These steeply sloping hearing losses are also referred to as ski-slope hearing losses due to the very characteristic curve for representing such a loss in an audiogram. Steeply sloping hearing losses are of the sensorineural type, which are the result of damaged hair cells in the cochlea.

People without acoustic perception in the higher frequencies (typically from between 2-8 kHz and above) have difficulties regarding not only their perception of speech, but also their perception of other useful sounds occurring in a modern society. Sounds of this kind may be alarm sounds, doorbells, ringing telephones, or birds singing, or they may be certain traffic sounds, or changes in sounds from machinery demanding immediate attention. For instance, unusual squeaking sounds from a bearing in a washing machine may attract the attention of a person with normal hearing so that measures may be taken in order to get the bearing fixed or replaced before a breakdown or a hazardous condition occurs. A person with a profound high frequency hearing loss, beyond the capabilities of the latest state-of-the-art hearing aid, may let this sound go on completely unnoticed because the main frequency components in the sound lie outside the person's effective auditory range even when aided.

High frequency information may, however, be conveyed in an alternative way to a person incapable of perceiving acoustic energy in the upper frequencies. This alternative method involves transposing a selected range or band of frequencies from a part of the frequency spectrum imperceptible to a person having a hearing loss to another part of the frequency spectrum where the same person still has at least some hearing ability remaining.

2. The Prior Art

WO-A1-2007/000161 provides a hearing aid having means for reproducing frequencies originating outside the perceivable audio frequency range of a hearing aid user. An imperceptible frequency range, denoted the source band, is selected and, after suitable band-limitation, transposed in frequency to the perceivable audio frequency range, denoted the target band, of the hearing aid user, and mixed with an untransposed part of the signal there. For selecting the frequency shift, the device is adapted for detecting and tracking a dominant frequency in the source band and a dominant frequency in the target band and using these frequencies to determine with greater accuracy how far the source band should be transposed in order to make the transposed dominant frequency in the source band coincide with the dominant frequency in the target band. This tracking is preferably carried out by an adaptable notch filter, where the adaptation is capable of moving the center frequency of the notch filter towards a dominant frequency in the source band in such a way that the output from the notch filter is minimized. This will be the case when the center frequency of the notch filter coincides with the dominating frequency.

The target frequency band usually comprises lower frequencies than the source frequency band, although this needs not necessarily be the case. The dominant frequency in the source band and the dominant frequency in the target band are both presumed to be harmonics of the same fundamental. The transposition is based on the assumption that a dominant frequency in the source band and a dominant frequency in the target band always have a mutual, fixed, integer relationship, e.g. if the dominant frequency in the source band is an octave above a corresponding, dominant frequency in the target band, that fixed integer relationship is 2. Thus, if the source band is transposed an appropriate distance down in frequency, the transposed, dominant source frequency will coincide with a corresponding frequency in the target band at a frequency one octave below. The inventor has discovered that, in some cases, this assumption may be incomplete. This will be described in further detail in the following.

Consider a naturally occurring sound consisting of a fundamental frequency and a number of harmonic frequencies. This sound may e.g. originate from a musical instrument or some natural phenomenon like e.g. birdsong or the voice of someone speaking. In a first case, the dominant frequency in the source band may be an even harmonic of the fundamental frequency, i.e. the frequency of the harmonic may be obtained by multiplying the frequency of the fundamental by an even number. In a second case, the dominant harmonic frequency may be an odd harmonic of the fundamental frequency, i.e. the frequency of the harmonic may be obtained by multiplying the frequency of the fundamental with an odd number.

If the dominant harmonic frequency in the source frequency band is an even harmonic of a fundamental frequency in the target band, the transposer algorithm of the above-mentioned prior art is always capable of transposing the source frequency band in such a way that the transposed dominant harmonic frequency coincides with another harmonic frequency in the target frequency band. If, however, the dominant harmonic frequency in the source frequency band is an odd harmonic of the fundamental frequency, the dominant source frequency no longer shares a mutual, fixed, integer relationship with any frequency present in the target band, and the transposed source frequency band will therefore not coincide with a corresponding, harmonic frequency in the target frequency band.

The resulting sound of the combined target band and the transposed source band may thus appear confusing and unpleasant to the listener, as an identifiable relationship between the sound of the target band and the transposed source band is no longer present in the combined sound.

Another inherent problem with the transposer algorithm of the prior art is that it does not take the presence of speech into account when transposing the signal. If voiced-speech signals are transposed according to the prior art algorithm, formants present in the speech signals will be transposed along with the rest of the signal. This may lead to a severe loss of intelligibility, since formant frequencies are an important key feature to the speech comprehension process in the human brain. Unvoiced-speech signals, however, like plosives or fricatives, may actually benefit from transposition, especially in cases where the frequencies of the unvoiced-speech signals fall outside the perceivable frequency range of the hearing-impaired user.

SUMMARY OF THE INVENTION

According to the invention, in a first aspect, a hearing aid is devised, said hearing aid having a signal processor comprising means for splitting an input signal into a first frequency band and a second frequency band, a first frequency detector capable of detecting a first characteristic frequency in the first frequency band, a second frequency detector capable of detecting a second characteristic frequency in the second frequency band, means for shifting the signal of the first frequency band a distance in frequency in order to form a signal falling within the frequency range of the second frequency band, at least one oscillator controlled by the first and second frequency detectors, means for multiplying the signal from the first frequency band with the output signal from the oscillator for creating the frequency-shifted signal falling within the second frequency band, means for superimposing the frequency-shifted signal onto the second frequency band, and means for presenting the combined signal of the frequency-shifted signal and the second frequency band to an output transducer, the means for shifting the signal of the first frequency band being controlled by the means for determining the fixed relationship between the first frequency and the second frequency.

By taking the relationship between the first frequency and the second frequency into account when transposing audio signals, a higher fidelity of the processed signals is achieved.

The invention, in a second aspect, provides a method of shifting audio frequencies in a hearing aid. The method involving the steps of obtaining an input signal, detecting a first dominating frequency in the input signal, detecting a second dominating frequency in the input signal, shifting a first frequency range of the input signal to a second frequency range of the input signal, superimposing the frequency-shifted first frequency range of the input signal to the second frequency range of the input signal according to a set of parameters derived from the input signal, wherein the step of detecting the first dominating frequency and the second dominating frequency incorporates the step of determining the presence of a fixed relationship between the first dominating frequency and the second dominating frequency, the step of shifting the first frequency range being controlled by the fixed relationship between the first dominating frequency and the second dominating frequency.

By utilizing a fixed relationship between the first and the second detected frequency for controlling the transposition of the hearing aid signals, a more comprehensible reproduction of the transposed signals is obtained.

Further features and embodiments are disclosed in the dependent claims.

BRIEF DESCRIPTION OF THE DRAWINGS

The invention will now be explained in greater detail with reference to the drawings, where.

DETAILED DESCRIPTION OF THE INVENTION

Figure 1:
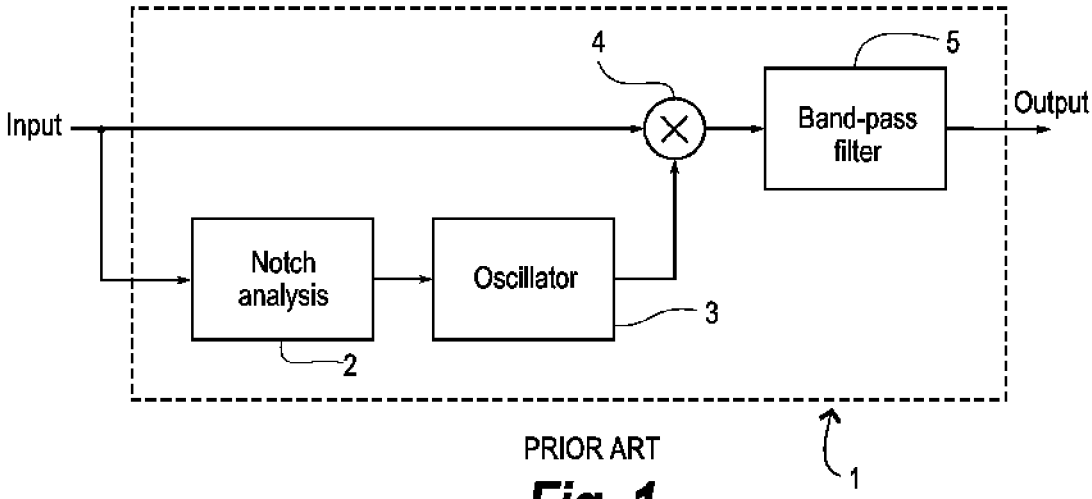
PRIOR ART Fig. 1
FIG. 1 is a block schematic of a prior art frequency transposer for a hearing aid.

FIG. 1 shows a block schematic of a prior art frequency transposer 1 for a hearing aid. The frequency transposer comprises a notch analysis block 2, an oscillator block 3, a mixer 4, and a band-pass filter block 5. An input signal is presented to the input of the notch analysis block 2. The input signal is an input signal comprising both a low-frequency part to be reproduced unaltered and a high-frequency part to be transposed.

In the notch analysis block 2, dominant frequencies present in the input signal are detected and analyzed, and the result of the analysis is a frequency value suitable for controlling the oscillator block 3. The oscillator block 3 generates a continuous sine wave with a frequency determined by the notch analysis block 2 and this sine wave is used as a modulating signal for the mixer 4. When the input signal is presented as a carrier signal to the input of the mixer 4, an upper and a lower sideband is generated from the input signal by modulation with the output signal from the oscillator block 3 in the mixer 4.

The upper sideband is filtered out by the band-pass filter block 5. The lower sideband, comprising a frequency-transposed version of the input signal ready for being added to the target frequency band, passes through the filter 5 to the output of the frequency transposer 1. The frequency-transposed output signal from the frequency transposer 1 is suitably amplified (amplifying means not shown) in order to balance its overall level carefully with the level of the low-frequency part of the input signal, and both the transposed high-frequency part of the input signal and the low-frequency part of the input signal are thus rendered audible to the hearing aid user.

Figure 2:
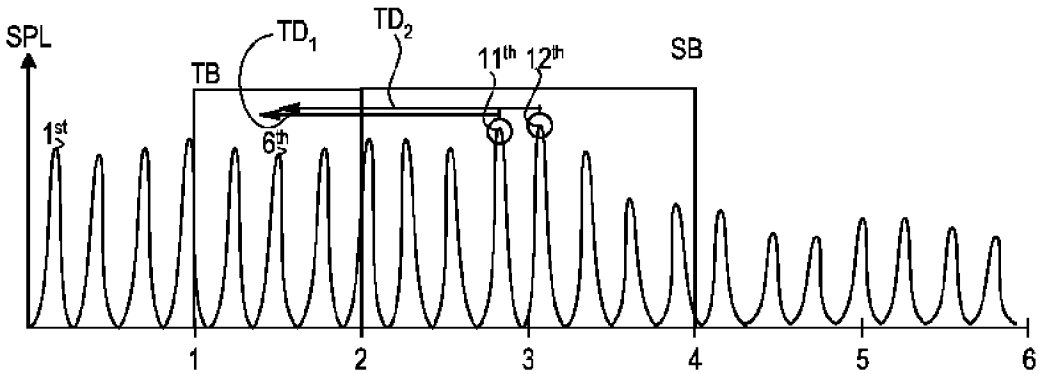
PRIOR ART Fig. 2
FIG. 2 is a frequency graph illustrating the operation of the prior art frequency transposer.

In FIG. 2 is shown the frequency spectrum of an input signal comprising a series of harmonic frequencies, $1^{st}$, $2^{nd}$, $3^{rd}$ etc., up to the $22^{nd}$ harmonic in order to illustrate how frequency transposing operates. For clarity, the fundamental frequency of the signal corresponding to the harmonic series is not shown in FIG. 2. Consider a potential hearing aid user having a hearing loss rendering all frequencies above 2 kHz unperceivable. Such a person would benefit from having part of the signal, say, a selected band of frequencies between 2 kHz and 4 kHz, transposed down in frequency to fall within a frequency band delimited by the frequencies 1 kHz and 2 kHz, respectively, in order to be able to perceive signals originally beyond the highest frequencies the hearing aid user is capable of hearing. This is illustrated in FIG. 2 by a first box, SB, defining the source band for the transposer, and a second box, TB, defining the target band for the transposer. In FIG. 2, the source frequency band, SB, is 2 kHz wide, and the target frequency band, TB, is 1 kHz wide. In order for the transposer algorithm to map the transposed frequency band correctly it is band-limited to a width of 1 kHz before being superimposed onto the target band. This may be thought of as a "frequency window", framing a band of 1 kHz around the dominant frequency from the source band for transposition.

The $11^{th}$ and $12^{th}$ harmonic frequencies in FIG. 2 are above the upper frequency limit of the person in the example but within the source band frequency limits. These harmonic frequencies are thus candidates for dominating frequencies for controlling the frequency band to be transposed down in frequency to the source band in order to be rendered perceivable by the hearing aid user in the example.

The prior art transposer band-limits the source band SB to 1 kHz by appropriate band-pass filtering, and transposes the band-limited portion of the input signal down to the target band by calculating a target frequency in the target band onto which the signal in the source band is mapped by the transposition process. The target frequency is calculated by tracking a dominating frequency in the source band and transposing a 1 kHz frequency band around this dominating frequency down by a fixed factor with respect to the dominating frequency. I.e. if the fixed factor is 2 and the dominating frequency tracked in the source band is, say, 3200 Hz, then the transposed signal will be mapped around a frequency of 1600 Hz. The transposed signal is then superimposed onto the signal already present in the target band, and the resulting signal is conditioned and presented to the hearing aid user.

The transposition of the source frequency band SB of the input signal is performed by multiplying the source frequency band signal by a precalculated sine wave function, the frequency of which is calculated in the manner described above. In most cases of natural sounds, the frequency tracked in the source band will be a harmonic frequency belonging to a fundamental frequency occurring simultaneously lower in the frequency spectrum. Transposing the source frequency band signal down by one or two octaves relative to the detected frequency would therefore ideally render it coinciding with a corresponding harmonic frequency below said hearing loss frequency limit, to make it blend in a pleasant and understandable way with the non-transposed part of the signal.

However, unless care is taken to ensure a correct harmonic relationship between the tracked harmonic frequency in the source band SB and the corresponding harmonic frequency in the target band TB prior to transposing the source band signal in the frequency spectrum, the transposed signal might accidentally be transposed in such a way that the transposed, dominant harmonic frequency from the source band would not coincide with a corresponding, harmonic frequency in the target band, but rather would end up at a frequency some distance from it. This would result in a discordant and unpleasant sound experience to the user, because the relationship between the transposed harmonic frequency from the source band and the corresponding, untransposed harmonic frequency already present in the target band would be uncontrolled. Such a situation is illustrated in FIG. 3.

Figure 3:
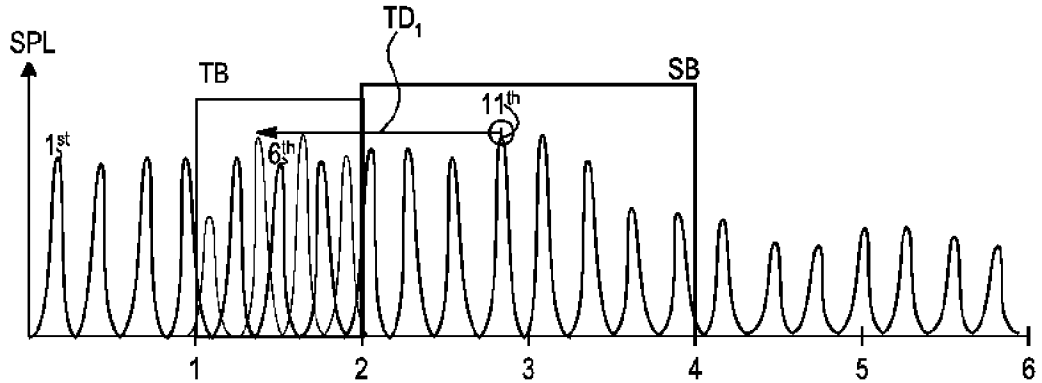
PRIOR ART Fig. 3
FIG. 3 is a frequency graph illustrating the problem of transposing a signal according to the prior art.

In the spectrum in FIG. 3 is shown a series of harmonic frequencies of an input signal of a hearing aid according to the prior art, similar to the series of harmonic frequencies shown in FIG. 2. The transposer algorithm is configured to transpose the source band SB down by one octave to coincide with the target band TB. In the source band SB, the $11^{th}$ and the $12^{th}$ harmonic frequency have equal levels and may therefore equally likely be detected and tracked by the transposing algorithm as the basis for transposing the source band signal part down to the target band. If the transposing algorithm of the prior art is allowed to choose freely between the $11^{th}$ harmonic frequency and the $12^{th}$ harmonic frequency as the source frequency used for transposition, it may in some cases accidentally choose the $11^{th}$ harmonic frequency instead of the $12^{th}$ harmonic frequency.

The $11^{th}$ harmonic has a frequency of approximately 2825 Hz in FIG. 3, and transposing it down the distance of $TD_1$ to the half of that frequency, would map it at approximately 1412.5 Hz, rendering the resulting, transposed sound unpleasant and may be even incomprehensible to the listener. If the $12^{th}$ harmonic, having a frequency of 2980 Hz, would have been chosen by the algorithm as a basis for transposition, then the transposed $12^{th}$ harmonic frequency would coincide perfectly with the $6^{th}$ harmonic frequency at 1490 Hz one octave lower in the target band, and the resulting sound would be much more pleasant and agreeable to the listener. The inconvenience of this uncertainty when transposing sounds in a hearing aid is alleviated by the invention.

Figure 4:
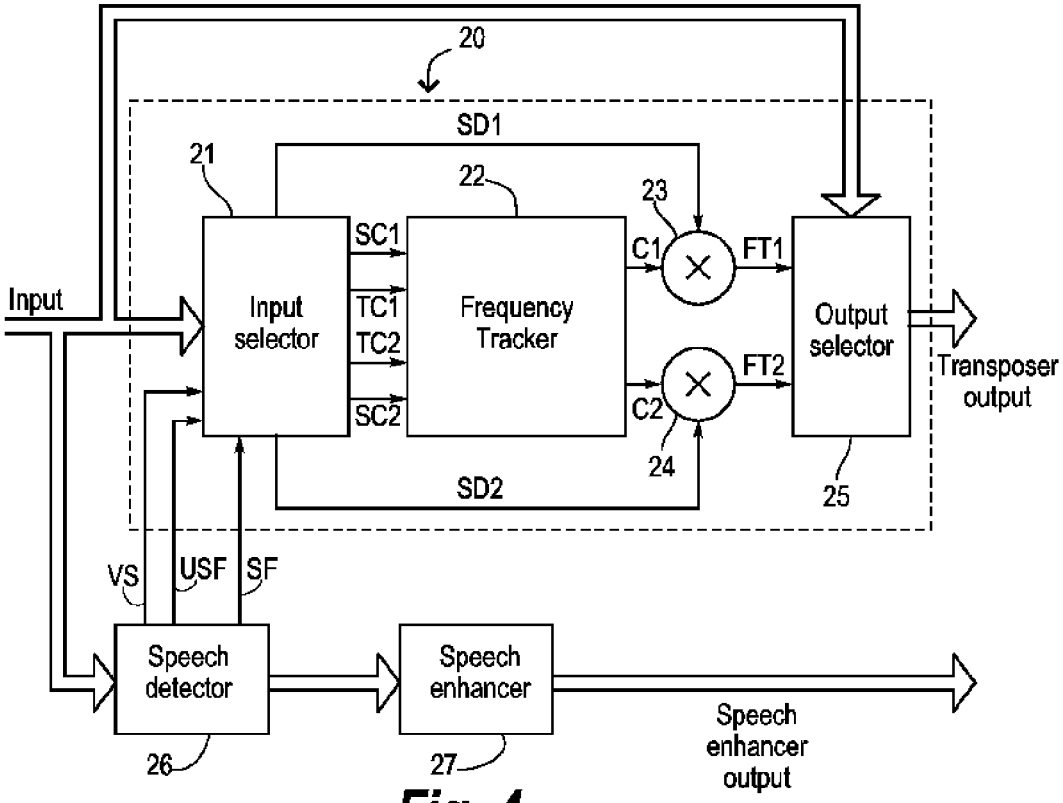
FIG. 4 is a block schematic of a frequency transposer comprising a harmonic frequency tracker according to an embodiment of the invention.

An embodiment of a frequency transposer 20 for a hearing aid according to the invention is shown in FIG. 4. The frequency transposer 20 comprises an input selector 21, a frequency tracker 22, a first mixer 23, a second mixer 24, and an output selector 25. Also shown in FIG. 4 is a speech detector block 26 and a speech enhancer block 27. An input signal is presented to the input selector 21 for determining which part of the frequency spectrum of the input signal is to be frequency-transposed, and to the output selector 25 for adding the untransposed part of the signal to the frequency-transposed part of the signal. The frequency transposer 20 is capable of independently transposing two different frequency bands of a source signal and map those frequency bands onto two different target bands independently and simultaneously. This feature allows for a more flexible setup of the band limits of the transposer frequency during fitting of the hearing aid and makes it possible to perform a more flexible frequency transposition as more than one source band is provided. The input selector 21 also provides suitable filtering of the parts of the input signal not to be transposed.

Other embodiments adapted for splitting the input signal into a higher number of source parts and target parts may be realized using the same principles.

Voiced-speech signals comprise a fundamental frequency and a number of corresponding harmonic frequencies in the same way as a lot of other sounds which may benefit from transposition. Voiced-speech signals may, however, suffer deterioration of intelligibility if they are transposed due to the formant frequencies present in voiced speech. Formant frequencies play a very important role in the cognitive processes associated with recognizing and differentiating between different vowels in speech. If the formant frequencies are moved away from their natural positions in the frequency spectrum, it becomes harder to recognize one vowel from another. Unvoiced-speech signals, on the other hand, may actually benefit from transposition. The speech detector 26 performs the task of detecting the presence of speech signals and separating voiced and unvoiced-speech signals in such a way that the unvoiced-speech signals are transposed and voiced-speech signals remain untransposed. For this purpose, the speech detector 26 generates three control signals for the input selector 21: A voiced-speech probability signal VS representing a measure of probability of the presence of voiced speech in the input signal, a speech flag signal SF indicating the presence of speech in the input signal, and an unvoiced-speech flag USF indicating the presence of unvoiced speech in the input signal. The speech detector also generates an output signal for the speech enhancer 27.

From the input signal and the control signals from the speech detector 26, the input selector 21 generates six different signals: A first source band control signal SC1, a second source band control signal SC2, a first target band control signal TC1, and a second target band control signal TC2, all intended for the frequency tracker 22, a first source band direct signal SD1, intended for the first mixer 23, and a second source band direct signal SD2, intended for the second mixer 24. Internally, the frequency tracker 22 determines a first source band frequency, a second source band frequency, a first target band frequency and a second target band frequency from the first source band control signal SC1, the second source band control signal SC2, the first target band control signal TC1, and the second target band control signal TC2, respectively. When the source band frequencies and the target band frequencies are known, the relationship between the source frequencies and the target frequencies may be calculated by the frequency tracker 22.

The first and the second source band frequencies are used to generate the first and the second carrier signals C1 and C2, respectively, for mixing with the first source band direct signal in the first mixer 23 and the second source band direct signal in the second mixer 24, respectively, in order to generate the first and the second frequency-transposed signals FT1 and FT2, respectively. The first and the second direct signals SD1 and SD2 are the band-limited parts of the signal to be transposed.

In the case of a voiced-speech signal being present in the input signal, as indicated by the level of the voiced-speech probability signal VS from the speech detector 26, the input signal should not be transposed. The input selector 21 is therefore configured to reduce the level of the first source band direct signal SD1 and the second source band direct signal SD2 by approximately 12 dB for as long as the voiced-speech signal is detected, and to bring back the level of the first source band direct signal SD1 and the second source band direct signal SD2 once the voiced-speech probability signal VS falls below a predetermined level, or the speech flag SF has gone logical LOW. This will reduce the output signal level from the transposer 20 whenever voiced speech is detected in the input signal. It should be noted, however, that this mechanism is intended to control the balance between the levels of the transposed and the untransposed signals. The proper amplification to be applied to each frequency band of the plurality of frequency bands is determined at a later stage in the signal processing chain.

In order to utilize the control signals VS, USF and SF generated by the speech detector 26 in the way stated above, the input selector 21 operates in the following way: Whenever the speech flag SF is logical HIGH, it signifies to the input selector 21 that a speech signal, voiced or unvoiced, is present in the input signal to be transposed. The input selector then uses the voiced speech probability level signal VS to determine the amount of voiced speech present in the input signal.

Whenever the voiced speech probability level VS exceeds a predetermined limit, the amplitudes of the first source band direct signal SD1 and the second source band direct signal SD2 are correspondingly reduced, thus reducing the signal levels of the modulated signal FT1 from the first mixer 23 and the modulated signal FT2 from the second mixer 24 presented to the output selector 25 accordingly. The net result is that the transposed parts of the signal are suppressed whenever voiced speech signals are present in the input signal, thereby effectively excluding voiced speech signals from being transposed by the frequency transposer 20.

In the case of an unvoiced-speech signal being present in the input signal, as indicated by the unvoiced-speech flag USF from the speech detector 26, the input signal should be transposed. The input selector 21 is therefore configured to increase the level of the transposed signal by a predetermined amount in order to enhance the unvoiced-speech signal for the duration of the unvoiced-speech signal. The predetermined amount of level increment of the input signal is to a certain degree dependable of the hearing loss, and may therefore be adjusted to a suitable level during fitting of the hearing aid. In this way, the transposer 20 may provide a benefit to the hearing aid user in perceiving unvoiced-speech signals.

In order to avoid residual signals when performing transposition, the mixers 23 and 24 in the transposer shown in FIG. 4 are preferably embodied as complex mixers. A complex mixer utilizes a complex carrier function y having the general formula:

$$y=x_{re}\cdot\cos(\phi)+x_{im}\cdot\sin(\phi)$$

where $x_{re}$ is the real part and $x_{im}$ is the imaginary part of the complex carrier function, and $\phi$ is the phase angle (in radians) of the signal WM from the frequency tracker. By using a complex function for mixing, the upper sideband of the transposed signal is eliminated in the process, thus eliminating the need for subsequent filtering or removal of residuals.

In another embodiment, a real mixer or modulator is used in the transposer. A signal modulated with a real mixer results in an upper sideband and a lower sideband being generated. In this embodiment, the upper sideband is removed by a filter prior to adding the transposed signal to the baseband signal. Apart from the added complexity by having an extra filter present, this method inevitably leaves an aliasing residue within the transposed part of the signal. This embodiment is therefore presently less favored.

The first frequency-transposed signal FT1 is the signal in the first source band transposed down by one octave, i.e. by a factor of 2, in order to make the first frequency-transposed signal FT1 coincide with the corresponding signal in the first target frequency band, and the second frequency-transposed signal FT2 is the signal in the second source band transposed down by a factor of 3, in order to make the second frequency-transposed signal FT2 coincide with the corresponding signal in the second target frequency band. This feature enables two different source frequency bands to be transposed simultaneously, and implies that the first and the second target band may be different from each other.

By mixing the first source band direct signal SD1 with the first output signal C1 from the frequency tracker 22 in the first mixer 23, a first frequency-transposed target band signal FT1 is generated for the output selector 25, and by mixing the second source band signal SD2 with the second output signal C2 from the frequency tracker 22 in the second mixer 24, a second frequency-transposed target band signal FT2 is generated for the output selector 25. In the output selector 25, the two frequency-transposed signals, FT1 and FT2, respectively, are blended with the untransposed parts of the input signal at levels suitable for establishing an adequate balance between the level of the untransposed signal part and levels of the transposed signal parts.

Figure 5:
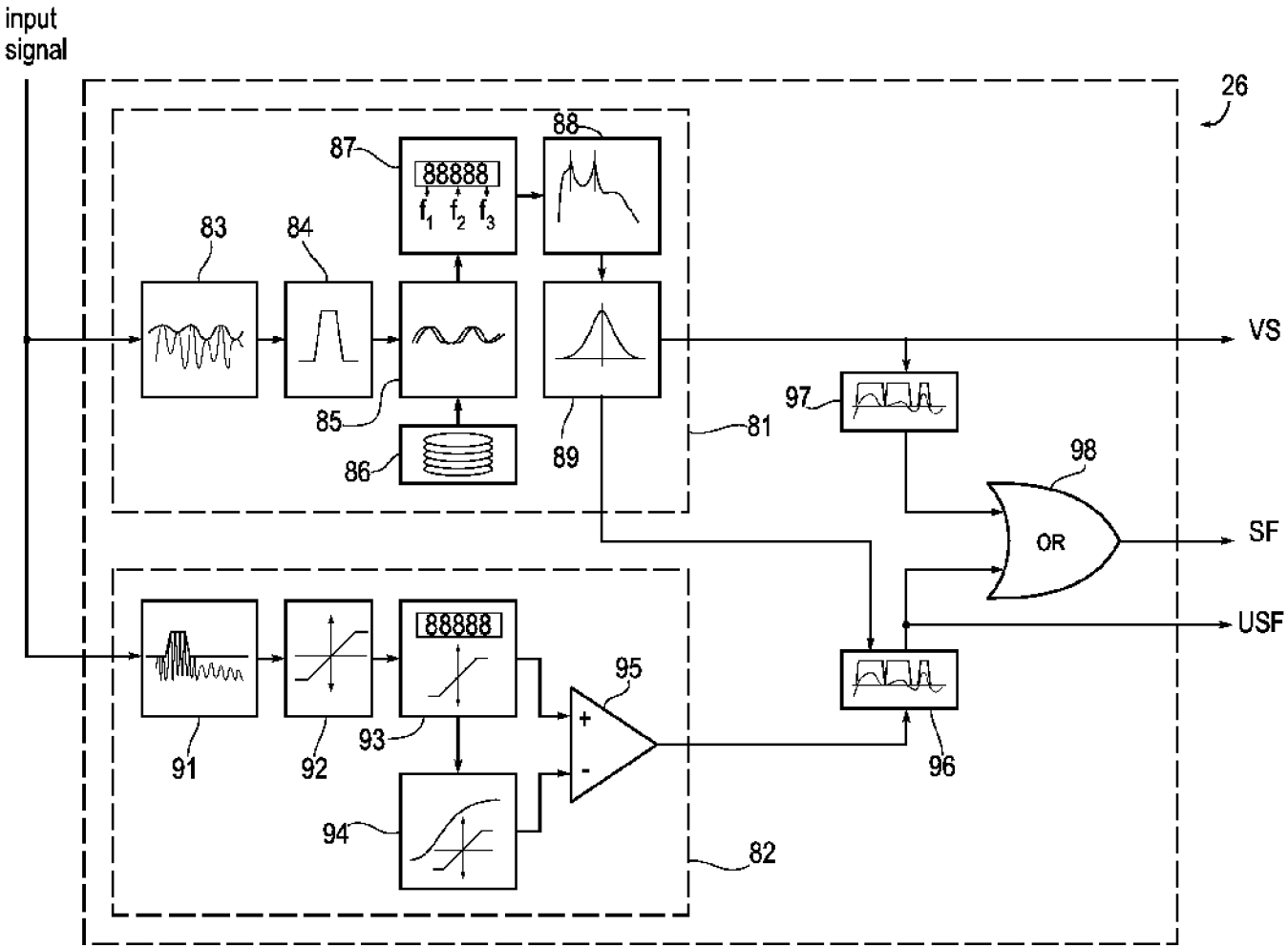
FIG. 5 is a block schematic of a speech detector for use in conjunction with the invention.

In FIG. 5 is shown a block schematic of a speech detector 26 for use in conjunction with the invention. The speech detector 26 is capable of detecting and discriminating voiced and unvoiced speech signals from an input signal, and it comprises a voiced-speech detector 81, an unvoiced-speech detector 82, an unvoiced-speech discriminator 96, a voiced-speech discriminator 97, and an OR-gate 98. The voiced-speech detector 81 comprises a speech envelope filter block 83, an envelope band-pass filter block 84, a frequency correlation calculation block 85, a characteristic frequency lookup table 86, a speech frequency count block 87, a voiced-speech frequency detection block 88, and a voiced-speech probability block 89. The unvoiced-speech detector 82 comprises a low level noise discriminator 91, a zero-crossing detector 92, a zero-crossing counter 93, a zero-crossing average counter 94, and a comparator 95.

The speech detector 26 serves to determine the presence and characteristics of speech, voiced and unvoiced, in an input signal. This information can be utilized for performing speech enhancement or, in this case, detecting the presence of voiced speech in the input signal. The signal fed to the speech detector 26 is a band-split signal from a plurality of frequency bands. The speech detector 26 operates on each frequency band in turn for the purpose of detecting voiced and unvoiced speech, respectively.

Voiced-speech signals have a characteristic envelope frequency ranging from approximately 75 Hz to about 285 Hz. A reliable way of detecting the presence of voiced-speech signals in a frequency band-split input signal is therefore to analyze the input signal in the individual frequency bands in order to determine the presence of the same envelope frequency, or the presence of the double of that envelope frequency, in all relevant frequency bands. This is done by isolating the envelope frequency signal from the input signal, band-pass filtering the envelope signal in order to isolate speech frequencies from other sounds, detecting the presence of characteristic envelope frequencies in the band-pass filtered signal, e.g. by performing a correlation analysis of the band-pass filtered envelope signal, accumulating the detected, characteristic envelope frequencies derived by the correlation analysis, and calculating a measure of probability of the presence of voiced speech in the analyzed signal from these factors thus derived from the input signal.

The correlation analysis performed by the frequency correlation calculation block 85 for the purpose of detecting the characteristic envelope frequencies is an autocorrelation analysis, and is approximated by:

$$R_{xx}(k) = \frac{1}{N}\sum_{n=0}^{N-1} x(n)\cdot x(n-k)$$

Where k is the characteristic frequency to be detected, n is the sample, and N is the number of samples used by the correlation window. The highest frequency detectable by the correlation analysis is defined by the sampling frequency $f_s$ of the system, and the lowest detectable frequency is dependent of the number of samples N in the correlation window, i.e.:

$$f_{max} = \frac{f_s}{k},\ f_{min} \approx f_s \cdot \frac{2}{N}$$

The correlation analysis is a delay analysis, where the correlation is largest whenever the delay time matches a characteristic frequency. The input signal is fed to the input of the voiced-speech detector 81, where a speech envelope of the input signal is extracted by the speech envelope filter block 83 and fed to the input of the envelope band-pass filter block 84, where frequencies above and below characteristic speech frequencies in the speech envelope signal are filtered out, i.e. frequencies below approximately 50 Hz and above 1 kHz are filtered out. The frequency correlation calculation block 85 then performs a correlation analysis of the output signal from the band-pass filter block 84 by comparing the detected envelope frequencies against a set of predetermined envelope frequencies stored in the characteristic frequency lookup table 86, producing a correlation measure as its output.

The characteristic frequency lookup table 86 comprises a set of paired, characteristic speech envelope frequencies (in Hz) similar to the set shown in table 1:

TABLE 1

Paired, characteristic speech envelope frequencies.

| | | | | | | | | | |
|---|---|---|---|---|---|---|---|---|---|
| 333 | 286 | 250 | 200 | 167 | 142 | 125 | 100 | 77 | 50 |
| — | 142 | 125 | 100 | 77 | 286 | 250 | 200 | 167 | — |

The upper row of table 1 represents the correlation speech envelope frequencies, and the lower row of table 1 represents the corresponding double or half correlation speech envelope frequencies. The reason for using a table of relatively few discrete frequencies in the correlation analysis is an intention to strike a balance between table size, detection speed, operational robustness and a sufficient precision. Since the purpose of performing the correlation analysis is to detect the presence of a dominating speaker signal, the exact frequency is not needed, and the result of the correlation analysis is thus a set of detected frequencies.

If a pure, voiced speech signal originating from a single speaker is presented as the input signal, only a few characteristic envelope frequencies will predominate in the input signal at a given moment in time. If the voiced speech signal is partially masked by noise, this will no longer be the case. Voiced speech may, however, still be determined with sufficient accuracy by the frequency correlation calculation block 85 if the same characteristic envelope frequency is found in three or more frequency bands.

The frequency correlation calculation block 85 generates an output signal fed to the input of the speech frequency count block 87. This input signal consists of one or more frequencies found by the correlation analysis. The speech frequency count block 87 counts the occurrences of characteristic speech envelope frequencies in the input signal. If no characteristic speech envelope frequencies are found, the input signal is deemed to be noise. If one characteristic speech envelope frequency, say, 100 Hz, or its harmonic counterpart, i.e. 200 Hz, is detected in three or more frequency bands, then the signal is deemed to be voiced speech originating from one speaker. However, if two or more different fundamental frequencies are detected, say, 100 Hz and 167 Hz, then voiced speech are probably originating from two or more speakers. This situation is also deemed as noise by the process.

The number of correlated, characteristic envelope frequencies found by the speech frequency count block 87 is used as an input to the voiced-speech frequency detection block 88, where the degree of predominance of a single voiced speech signal is determined by mutually comparing the counts of the different envelope frequency pairs. If at least one speech frequency is detected, and its level is considerably larger than the envelope level of the input signal, then voiced speech is detected by the system, and the voiced-speech frequency detection block 88 outputs a voiced-speech detection value as an input signal to the voiced-speech probability block 89. In the voiced-speech probability block 89, a voiced speech probability value is derived from the voiced-speech detection value determined by the voiced-speech frequency detection block 88. The voiced-speech probability value is used as the voiced-speech probability level output signal from the voiced-speech detector 81.

Unvoiced speech signals, like fricatives, sibilants and plosives, may be regarded as very short bursts of sound without any well-defined frequency, but having a lot of high-frequency content. A cost-effective and reliable way to detect the presence of unvoiced-speech signals in the digital domain is to employ a zero-crossing detector, which gives a short impulse every time the sign of the signal value changes, in combination with a counter for counting the number of impulses, and thus the number of zero crossing occurrences in the input signal within a predetermined time period, e.g. one tenth of a second, and comparing the number of times the signal crosses the zero line to an average count of zero crossings accumulated over a period of e.g. five seconds. If voiced speech has occurred recently, e.g. within the last three seconds, and the number of zero crossings is larger than the average zero-crossing count, then unvoiced speech is present in the input signal.

The input signal is also fed to the input of the unvoiced-speech detector 82 of the speech detector 26, to the input of the low-level noise discriminator 91. The low-level noise discriminator 91 rejects signals below a certain volume threshold in order for the unvoiced-speech detector 82 to be able to exclude background noise from being detected as unvoiced-speech signals. Whenever an input signal is deemed to be above the threshold of the low-level noise discriminator 91, it enters the input of the zero-crossing detector 92.

The zero-crossing detector 92 detects whenever the signal level of the input signal crosses zero, defined as ½ FSD (full-scale deflection), or half the maximum signal value that can be processed, and outputs a pulse signal to the zero-crossing counter 93 every time the input signal thus changes sign. The zero-crossing counter 93 operates in time frames of finite duration, accumulating the number of times the signal has crossed the zero threshold within each time frame. The number of zero crossings for each time frame is fed to the zero-crossing average counter 94 for calculating a slow average value of the number of zero crossings of several consecutive time frames, presenting this average value as its output signal. The comparator 95 takes as its two input signals the output signal from the zero-crossing counter 93 and the output signal from the zero-crossing average counter 94 and uses these two input signals to generate an output signal for the unvoiced-speech detector 82 equal to the output signal from the zero-crossing counter 93 if this signal is larger than the output signal from the zero-crossing average counter 94, and equal to the output signal from the zero-crossing average counter 94 if the output signal from the zero-crossing counter 93 is smaller than the output signal from the zero-crossing average counter 94.

The output signal from the voiced-speech detector 81 is branched to a direct output, carrying the voiced-speech probability level, and to the input of the voiced-speech discriminator 97. The voiced-speech discriminator 97 generates a HIGH logical signal whenever the voiced-speech probability level from the voiced-speech detector 81 rises above a first predetermined level, and a LOW logical signal whenever the speech probability level from the voiced-speech detector 81 falls below the first predetermined level.

The output signal from the unvoiced-speech detector 82 is branched to a direct output, carrying the unvoiced-speech level, and to a first input of the unvoiced-speech discriminator 96. A separate signal from the voiced-speech detector 81 is fed to a second input of the unvoiced-speech discriminator 96. This signal is enabled whenever voiced speech has been detected within a predetermined period, e.g. 0.5 seconds. The unvoiced-speech discriminator 96 generates a HIGH logical signal whenever the unvoiced speech level from the unvoiced-speech detector 82 rises above a second predetermined level and voiced speech has been detected within the predetermined period, and a LOW logical signal whenever the speech level from the unvoiced-speech detector 82 falls below the second predetermined level.

The OR-gate 98 takes as its two input signals the logical output signals from the unvoiced-speech discriminator 96 and the voiced-speech discriminator 97, respectively, and generates a logical speech flag for utilization by other parts of the hearing aid circuit. The speech flag generated by the OR-gate 98 is logical HIGH if either the voiced-speech probability level or the unvoiced-speech level is above their respective, predetermined levels and logical LOW if both the voiced-speech probability level and the unvoiced-speech level are below their respective, predetermined levels. Thus, the speech flag generated by the OR-gate 98 indicates if speech is present in the input signal.

Figure 6:
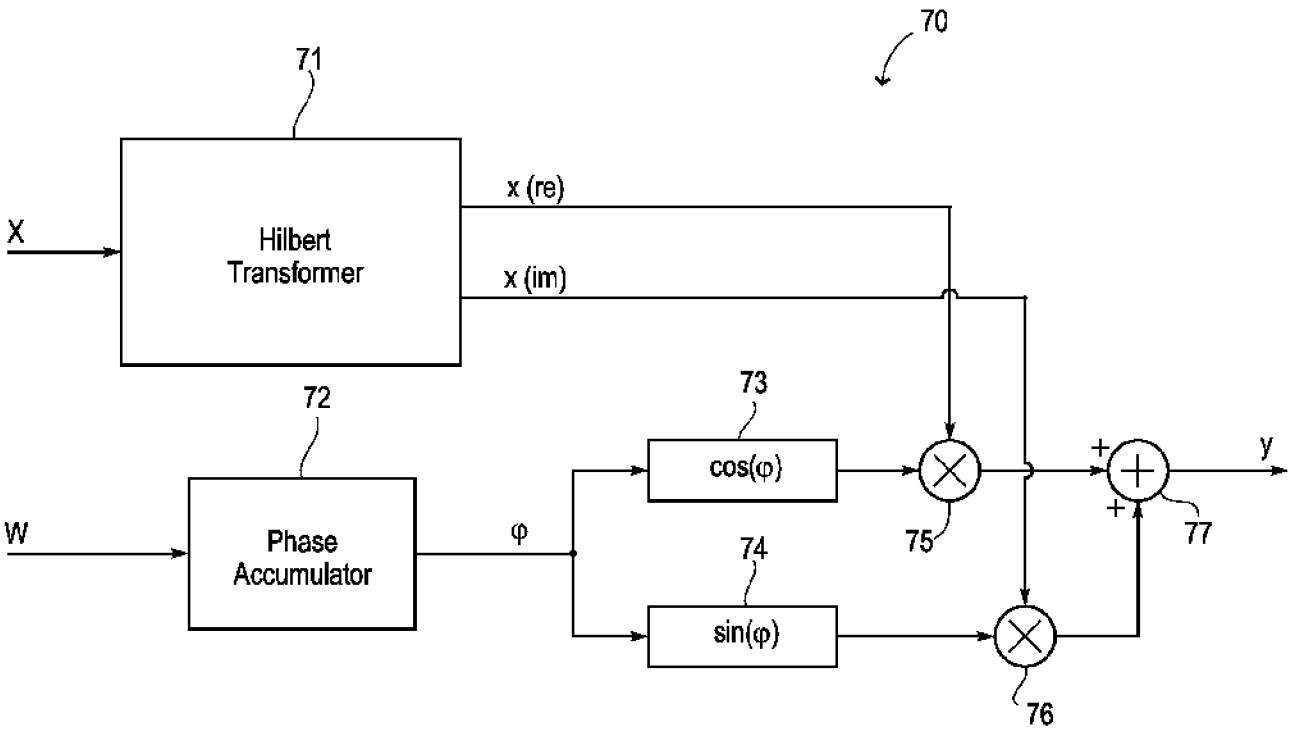
FIG. 6 is a block schematic of a complex modulation mixer for use in the invention.

A block schematic of an embodiment of a complex mixer 70 for use with the invention for implementing each of the mixers 23 and 24 in FIG. 4 is shown in FIG. 6. The purpose of a complex mixer is to generate a lower sideband frequency-shifted version of the input signal in a desired frequency range without generating an unwanted upper sideband at the same time, thus eliminating the need for an additional low-pass filter serving to eliminate the unwanted upper sideband. The complex mixer 70 comprises a Hilbert transformer 71, a phase accumulator 72, a cosine function block 73, a sine function block 74, a first multiplier node 75, a second multiplier node 76 and a summer 77. The purpose of the complex mixer 70 is to perform the actual transposition of the source signal X from the source frequency band to the target frequency band by complex multiplication of the source signal with a transposing frequency W, the result being a frequency-transposed signal y.

The signal to be transposed enters the Hilbert transformer 71 of the complex mixer 70 as the input signal X, representing the source band of frequencies to be frequency-transposed. The Hilbert transformer 71 outputs a real signal part $x_{re}$ and an imaginary signal part $x_{im}$, which is phase-shifted −90° relative to the real signal part $x_{re}$. The real signal part $x_{re}$ is fed to the first multiplier node 75, and the imaginary signal part $x_{im}$ is fed to the second multiplier node 76.

The transposing frequency W is fed to the phase accumulator 72 for generating a phase signal $\phi$. The phase signal $\phi$ is split into two branches and fed to the cosine function block 73 and the sine function block 74, respectively, for generating the cosine and the sine of the phase signal $\phi$, respectively. The real signal part $x_{re}$ is multiplied with the cosine of the phase signal $\phi$ in the first multiplier node 75, and the imaginary signal part $x_{im}$ is multiplied with the sine of the phase signal $\phi$ in the second multiplier node 76.

In the summer 77 of the complex mixer 70, the output signal from the second multiplier node 76, carrying the product of the imaginary signal part $x_{im}$ and the sine of the phase signal $\phi$, is added to the output signal from the first multiplier node 75 carrying the product of the real signal part $x_{re}$ and the cosine of the phase signal $\phi$, producing the frequency-transposed output signal y. The output signal y from the complex mixer 70 is then the lower side band of the frequency-transposed source frequency band, coinciding with the target band.

In order to ensure that a first harmonic frequency in a transposed signal always corresponds to a second harmonic frequency in a non-transposed signal, both the first harmonic frequency and the second harmonic frequency should be detected by the frequency tracker 22 of the frequency transposer 20 in FIG. 4. The mutual frequency relationship between the first harmonic frequency and the second harmonic frequency should be verified prior to performing any transposition based on the first harmonic frequency. Since the frequency of an even harmonic is always N times the frequency of a corresponding harmonic N octaves below, the key to determining if two harmonic frequencies belongs together is to utilize two notch filters, one for detecting harmonics in the source band and one for detecting corresponding harmonics in the target band, while keeping the relationship between the detected harmonic frequencies constant. This is preferably implemented by a suitable algorithm executed by a digital signal processor in a state-of-the-art, digital hearing aid. Such an algorithm is explained in greater detail in the following.

A notch filter is preferably implemented in the digital domain as a second-order IIR filter having the following general transfer function:

$$H(z) = \frac{D(z)}{N(z)} = \frac{1 + c \cdot z^{-1} + z^{-2}}{1 + r \cdot c \cdot z^{-1} + r^2 \cdot z^{-2}}$$

where c is the notch coefficient and r is the pole radius of the filter ($0<r<1$). The notch coefficient c may be expressed as a function of the frequency w in radians thus:

$$c = -2\cos(w)$$

In order to make the frequency of the notch filter freely variable, various approaches are known in the prior art. A simple, but effective method, deemed sufficiently accurate for the purpose of the invention, is an approximating method known as the simplified gradient descent method. Such a method requires an approximation of the gradient of the notch filter transfer function, which may be found by differentiating the numerator D(z) of the transfer function H(z) with respect to c, obtaining the gradient of the filter transfer function thus:

$$\frac{\partial H(z)}{\partial c} = \frac{\partial D(z)}{N(z)} = \frac{z^{-1}}{1 + r \cdot c \cdot z^{-1} + r^2 \cdot z^{-2}}$$

The notch frequency of a notch filter may then be determined directly by applying the approximated gradient as a converted coefficient c to the notch filter.

In order to verify that the detected source frequency is an even harmonic of the fundamental, the ratio between the detected source frequency and the detected target frequency is presumed to be a whole, positive constant N, i.e. the detected source frequency is N times the detected target frequency. Based on this assumption, the notch coefficient of the source notch filter may be expressed as:

$$c_s = -2\cos(N \cdot w)$$

and the notch coefficient of the target notch filter thus becomes:

$$c_t = -2\cos(w)$$

For the harmonic relationship of an octave between the source frequency and the target frequency, i.e. N=2, the relationship between $c_s$ and $c_t$ is found by using trigonometric identities:

$$c_s = 1 - c_t^2$$

The source notch filter gradient may then be found by substituting $c_s$ and differentiating with respect to $c_t$ in the way stated above:

$$\frac{\partial H_s(z)}{\partial c_t} = \frac{\partial H_s(z)}{1 + r \cdot c_s \cdot z^{-1} + r^2 \cdot z^{-2}},$$

$$H_s(z) = 1 + (1 - c_t^2) \cdot z^{-1} + z^{-2} \Rightarrow \frac{\partial H_s(z)}{\partial c_t} = \frac{-2 \cdot c_t \cdot z^{-1}}{1 + r \cdot c_s \cdot z^{-1} + r^2 \cdot z^{-2}}$$

The combined simplified gradient G(z) of the two notch filters is thus a weighted sum of their individual simplified gradients and may be expressed as:

$$G(z) = \frac{z^{-1}}{1 + r \cdot c_t \cdot z^{-1} + r^2 \cdot z^{-2}} + \frac{-2 \cdot c_t \cdot z^{-1}}{1 + r \cdot c_s \cdot z^{-1} + r^2 \cdot z^{-2}}$$

By using the weighted sum of the gradients of the two notch filters as the combined, simplified gradient G(z) it is thus ensured that the frequency generated for transposition of the source band always makes the dominant frequency in the transposed source band coincide with the correct dominant frequency in the target band.

The combined, simplified gradient G(z) is used by the transposer to find local minima of the input signal in the source band and the target band, respectively. If a dominating frequency exists in the source frequency band, then the first individual gradient expression of G(z) has a local minimum at the dominating source frequency, and if a corresponding, dominating frequency exists in the target frequency band, then the second individual gradient expression of G(z) also has a local minimum at the dominating target frequency. Thus, if both the source frequency and the target frequency render a local minimum, then the source band is transposed.

In an embodiment of the invention, the signal processor performing the transposing algorithm is operating at a sample rate of 32 kHz. By using the gradient-descent-based algorithm described in the foregoing, the frequency tracker 22 of the transposer 20 is capable of tracking dominating frequencies in the input signal at a speed of up to 60 Hz/sample, with a typical tracking speed of 2-10 Hz/sample, while keeping a sufficient accuracy.

In order to transpose higher harmonic frequency bands than possible with one transposer, a second transposer exploiting the harmonic target frequency two octaves below the harmonic source frequency, i.e. N=3, may also be easily employed by applying the same principle. Such a second transposer, having a second source notch filter and a second target notch filter, performs a separate operation on a source band higher in the frequency spectrum corresponding to a transposition by a factor of four, i.e. two octaves. In this case, the source notch filter gradient for N=3 then becomes:

$$\frac{\partial H_s(z)}{\partial c_t} = \frac{-3(1-c_t^2)\cdot z^{-1}}{1+r\cdot c_s\cdot z^{-1}+r^2\cdot z^{-2}}$$

In this way the output of two or more notch filters may be combined to form a single notch output and a single gradient to be adapted on. Similarly, source notch filter gradients for transposing higher frequency bands, i.e. higher numbers of N, may be utilized by the invention for processing higher harmonics relating to the target frequency.

Figure 7:
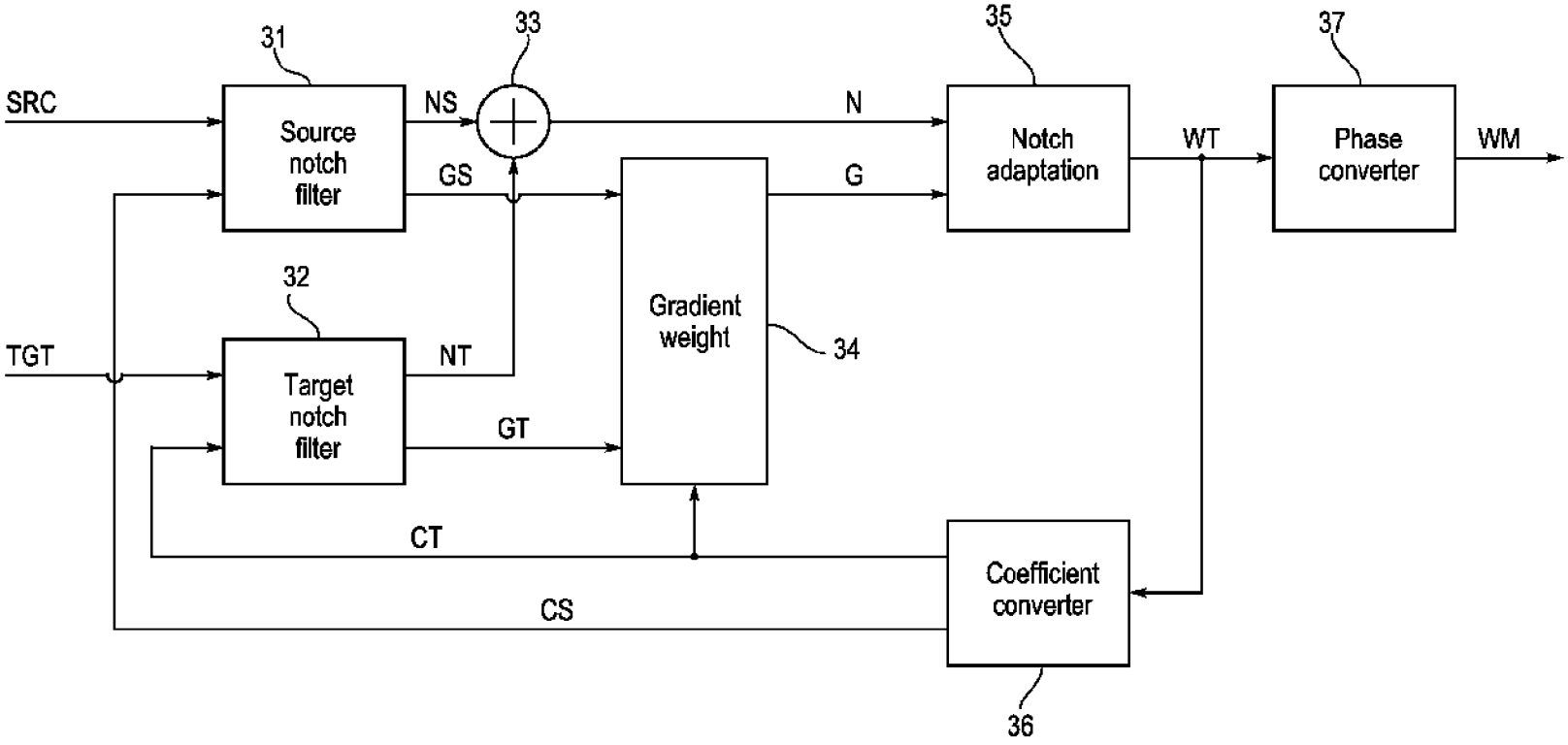
FIG. 7 is a block schematic of a harmonic frequency tracker according to an embodiment of the invention.

In FIG. 7 is shown an embodiment of a frequency tracker 22 according to the invention. The frequency tracker 22 comprises a source notch filter block 31, a target notch filter block 32, a summer 33, a gradient weight generator block 34, a notch adaptation block 35, a coefficient converter block 36 and an output phase converter block 37. The purpose of the frequency tracker 22 is to detect corresponding, dominant frequencies in the source band and the target band, respectively, for the purpose of controlling the transposition process.

The source notch filter 31 takes a source frequency band signal SRC and a source coefficient signal CS as its input signals and generates a source notch signal NS and a source notch gradient signal GS. The source notch signal NS is added to a target notch frequency signal NT in the summer 33, generating a notch signal N. The source notch gradient signal GS is used as a first input signal to the gradient weight generator block 34. The target notch filter block 32 takes a target frequency band signal TGT and a target coefficient signal CT as its input signals and generates the target notch signal NT and a target notch gradient signal GT. The target notch signal NT is added to the source notch signal NS in the summer 33, generating the notch signal N, as stated above. The target notch gradient signal GT is used as a second input signal to the gradient weight generator block 34.

The gradient weight generator block 34 generates a gradient signal G from the target coefficient signal CT and the notch gradient signals GS and GT from the source notch filter 31 and the target notch filter 32, respectively. The notch signal N from the summer 33 is used as a first input and the gradient signal G from the gradient weight generator block 34 is used as a second input to the notch adaptation block 35 for generating a target weight signal WT. The target weight signal WT from the notch adaptation block 35 is used both as the input signal to the coefficient converter block 36 for generating the coefficient signals CS and CT, respectively, and as the input signal to the output phase converter block 37.

The output phase converter block 37 generates a weighted mixer control frequency signal WM for the mixer (not shown) in order to transpose the source frequency band to the target frequency band. The weighted mixer control frequency signal WM corresponds to the transposing frequency input W in FIG. 6, and determines, in a way to be explained below, directly how far from its origin the source frequency band is to be transposed.

The frequency tracker 22 determines the optimum frequency shift for the source frequency band to be transposed by analyzing both the source frequency band and the target frequency band for dominant frequencies and using the relationship between the detected, dominant frequencies in the source frequency band and the target frequency band to calculate the magnitude of the frequency shift to perform. The way this analysis is carried out by the invention is explained in further detail in the following.

In order for the frequency tracker 22 to generate the frequency for controlling the transposer according to the invention, the source notch frequency detected by the source notch filter block 31 is presumed to be an even harmonic of the fundamental, and the target notch frequency detected by the target notch filter block 32 is presumed to be a harmonic frequency having a fixed relationship to the even harmonic of the source frequency band, thus the source notch filter block 31 and the target notch filter block 32 have to work in parallel, exploiting the existence of a fixed relationship between the two notch frequencies detected by the two notch filters. This implies that a combined gradient must be available to the frequency tracker 22. The combined gradient G(z) may be expressed as the sum of the gradients of the source notch filter 31 and the target notch filter 32 according to the algorithm described in the foregoing, thus:

$$G(z) = \frac{\partial H_s(z)}{\partial c} + \frac{\partial H_t(z)}{\partial c}$$

where $H_s(z)$ is the transfer function of the source notch filter block 31 and $H_t(z)$ is the transfer function of the target notch filter block 32.

Figure 8:
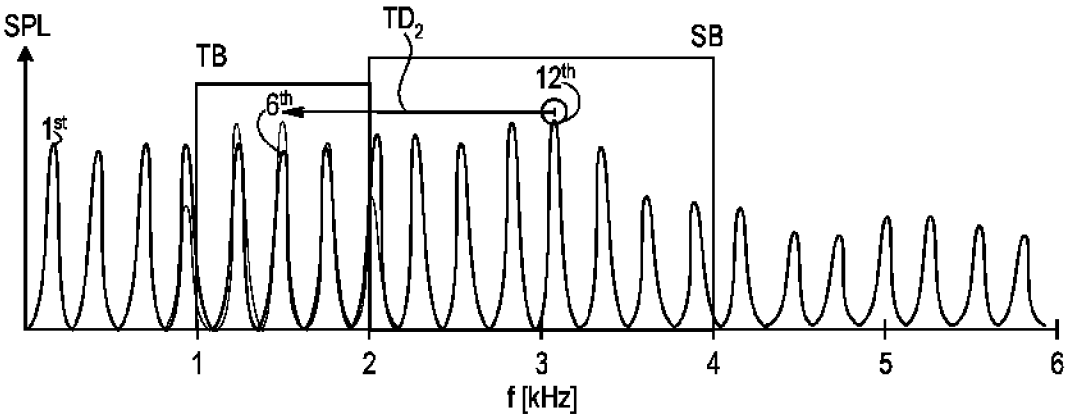
FIG. 8 is a frequency graph illustrating transposing a signal with harmonic frequency tracking.

FIG. 8 is a frequency graph illustrating how the problem of tracking harmonics of a target frequency correctly is solved by the frequency transposer according to the invention. In the frequency spectrum in FIG. 8 is shown a series of harmonic frequencies of an input signal of a hearing aid according to the invention in a similar way to the series of harmonic frequencies shown in FIG. 2. As in FIG. 2 and FIG. 3, the fundamental frequency corresponding to the series of harmonic frequencies is not shown. The transposer algorithm is not allowed to choose freely between the $11^{th}$ harmonic and the $12^{th}$ harmonic but is instead forced to choose an even harmonic frequency in the source band as the basis for transposition. As shown previously, all even harmonic frequencies have a corresponding harmonic frequency at half the frequency of the even harmonic frequency. Thus, in this case, the $12^{th}$ harmonic frequency is chosen as the basis for transposition by the frequency transposer. The $12^{th}$ harmonic frequency will coincide with the $6^{th}$ harmonic frequency when transposed down in frequency by an octave onto the target band TB by the distance $TD_2$. Likewise, the $13^{th}$ harmonic frequency will coincide with the $7^{th}$ harmonic frequency the $11^{th}$ harmonic frequency will coincide with the $5^{th}$ harmonic frequency, etc., in the target band TB shown in FIG. 8.

This result is accomplished by the invention by analyzing the detected $12^{th}$ harmonic frequency in the source band SB and the detected corresponding $6^{th}$ harmonic frequency in the target band TB prior to transposition in order to verify that a harmonic relationship exists between the two frequencies. Thus, a more suitable transposing frequency distance $TD_2$ is determined, and the transposed $10^{th}$, $11^{th}$, $12^{th}$, $13^{th}$ and $14^{th}$ harmonic frequencies of the transposed signal, shown in a thinner outline in FIG. 8, now coincide with respective corresponding $4^{th}$, $5^{th}$, $6^{th}$, $7^{th}$ and $8^{th}$ harmonic frequencies in the target band TB when the transposed source band signal is superimposed onto the target band, resulting in a much more pleasant and agreeable sound being presented to the user.

If e.g. the $14^{th}$ harmonic frequency in the source band SB were to be chosen as the basis for transposition instead of the $12^{th}$ harmonic frequency, it would coincide with the $7^{th}$ harmonic frequency in the target band TB when transposed by the transposer according to the invention, and the neighboring harmonic frequencies from the transposed source band SB would coincide in a similar manner with each of their corresponding harmonic frequencies in the target band TB. As long as the source band frequency is found to be an even harmonic frequency of a fundamental frequency by the combined frequency trackers, the transposer according to the invention is capable of transposing a frequency band around the detected, even harmonic frequency down to a lower frequency band to coincide with a detected, harmonic frequency present there.

Figure 9:
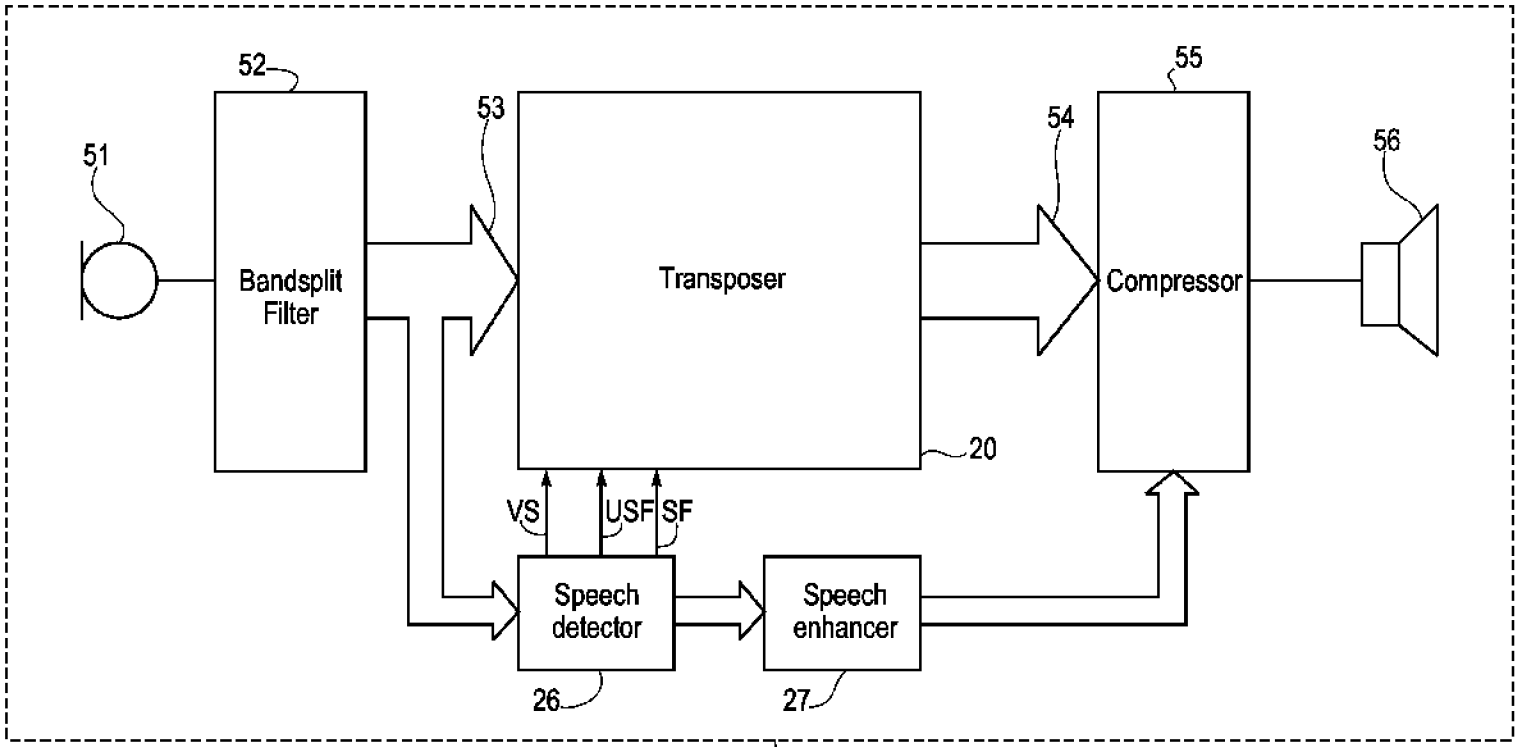
FIG. 9 is a block schematic of a hearing aid incorporating a frequency transposer according to an embodiment of the invention.

FIG. 9 is a block schematic showing a hearing aid 50 comprising a frequency transposer 20 according to the invention. The hearing aid 50 comprises a microphone 51, a band split filter 52, an input node 53, a speech detector 26, a speech enhancer 27, the frequency transposer 20, an output node 54, a compressor 55, and an output transducer 56. For clarity, amplifiers, program storage means, analog-to-digital converters, digital-to-analog converters and frequency-dependent prescription amplification means of the hearing aid are not shown in FIG. 9.

During use, an acoustical signal is picked up by the microphone 51 and converted into an electrical signal suitable for amplification by the hearing aid 50. The electrical signal is separated into a plurality of frequency bands in the band split filter 52, and the resulting, band-split signal enters the frequency transposer 20 via the input node 53. In the frequency transposer 20, the signal is processed in the way presented in conjunction with FIG. 4.

The output signal from the band-split filter 52 is also fed to the input of the speech detector 26 for generation of the three control signals VS, USF and SF, (explained above in the context of FIG. 4) intended for the frequency transposer block 20, and of a fourth control signal intended for the speech enhancer block 27. The speech enhancer block 27 performs the task of increasing the signal level in the frequency bands where speech is detected if the broad-band noise level is above a predetermined limit by controlling the gain values of the compressor 55. The speech enhancer block 27 uses the control signal from the speech detector 26 to calculate and apply a speech enhancement gain value to the gain applied to the signal in the individual frequency bands if speech is detected and noise does not dominate over speech in a particular frequency band. This enables the frequency bands comprising speech signals to be amplified above the broad-band noise in order to improve speech intelligibility.

The output signal from the frequency transposer 20 is fed to the input of the compressor 55 via the output node 54. The purpose of the compressor 55 is to reduce the dynamic range of the combined output signal according to a hearing aid prescription in order to reduce the risk of loud audio signals exceeding the so-called upper comfort limit (UCL) of the hearing aid user while ensuring that soft audio signals are amplified sufficiently to exceed the hearing aid user's hearing threshold limit (HTL). The compression is performed posterior to the frequency-transposition in order to ensure that the frequency-transposed parts of the signal are also compressed according to the hearing aid prescription.

The output signal from the compressor 55 is amplified and conditioned (means for amplification and conditioning not shown) for driving the output transducer 56 for acoustic reproduction of the output signal from the hearing aid 50. The signal comprises the non-transposed parts of the input signal with the frequency-transposed parts of the input signal superimposed thereupon in such a way that the frequency-transposed parts are rendered perceivable to a hearing-impaired user otherwise being incapable of perceiving the frequency range of those parts. Furthermore, the frequency-transposed parts of the input signal are rendered audible in such a way as to be as coherent as possible with the non-transposed parts of the input signal.

We claim:

1. A hearing aid having a signal processor comprising means for splitting an input signal into a first frequency band and a second frequency band, a first frequency detector capable of detecting a first characteristic frequency in the first frequency band, a second frequency detector capable of detecting a second characteristic frequency in the second frequency band, means for shifting the signal of the first frequency band a distance in frequency in order to form a signal falling within the frequency range of the second frequency band, at least one oscillator controlled by the first and second frequency detectors, means for multiplying the signal from the first frequency band with the output signal from the oscillator for creating the frequency-shifted signal falling within the second frequency band, means for superimposing the frequency-shifted signal onto the second frequency band, and means for presenting the combined signal of the frequency-shifted signal and the second frequency band to an output transducer, the means for shifting the signal of the first frequency band being controlled by the means for determining the fixed relationship between the first frequency and the second frequency.

2. The hearing aid according to claim 1, wherein the means for detecting a first frequency in the input signal is a first notch filter having a first notch gradient, and the means for detecting a second frequency in the input signal is a second notch filter having a second notch gradient.

3. The hearing aid according to claim 1, wherein the means for determining the presence of a fixed relationship between the first frequency and the second frequency in the input signal comprises means for generating a combined gradient by combining the first and the second notch gradient.

4. The hearing aid according to claim 3, wherein the means for shifting the signal of the first frequency band to the second frequency band is controlled by the means for generating a combined gradient.

5. The hearing aid according to claim 1, comprising means for detecting the presence of a voiced-speech signal and means for detecting an unvoiced-speech signal in the input signal.

6. The hearing aid according to claim 5, wherein the means for detecting the presence of a voiced speech signal comprises means for disabling frequency shifting of the voiced speech signal.

7. The hearing aid according to claim 5, wherein the means for detecting the presence of an unvoiced speech signal comprises means for enabling frequency shifting of the unvoiced speech signal.

8. The hearing aid according to claim 5, wherein the means for detecting a voiced speech signal comprises an envelope filter for extracting an envelope signal from the input signal.

9. The hearing aid according to claim 5, wherein the means for detecting unvoiced speech signal comprises a zero-crossing rate counter and an averaging zero-crossing rate counter for detecting an unvoiced speech level in the envelope signal.

10. A method of shifting audio frequencies in a hearing aid, said method involving the steps of obtaining an input signal, detecting a first dominating frequency in the input signal, detecting a second dominating frequency in the input signal, shifting a first frequency range of the input signal to a second frequency range of the input signal, superimposing the frequency-shifted first frequency range of the input signal to the second frequency range of the input signal according to a set of parameters derived from the input signal, wherein the step of detecting the first dominating frequency and the second dominating frequency incorporates the step of determining the presence of a fixed relationship between the first dominating frequency and the second dominating frequency, the step of shifting the first frequency range being controlled by the fixed relationship between the first dominating frequency and the second dominating frequency.

11. The method according to claim 10, wherein the step of detecting a first dominating frequency and a second dominating frequency in the input signal involves deriving a first notch gradient and a second notch gradient from the input signal.

12. The method according to claim 11, wherein the step of determining the presence of a fixed relationship between the first dominating frequency and the second dominating frequency in the input signal involves combining the first notch gradient and the second notch gradient into a combined gradient and using the combined gradient for shifting the first frequency range of the input signal to the second frequency range of the input signal.

13. The method according to claim 10, wherein the step of superimposing the frequency-shifted first frequency range onto the second frequency range uses the presence of the fixed relationship between the first dominating frequency and the second dominating frequency as a parameter for determining the output level of the frequency-shifted first frequency range.

14. The method according to claim 11, wherein the step of detecting the first dominating frequency and the second dominating frequency involves the steps of detecting the presence of a voiced-speech signal and an unvoiced-speech signal, respectively, in the input signal, enhancing frequency shifting of the unvoiced-speech signal and suppressing frequency shifting of the voiced-speech signal.

* * * * *